US007528311B2

(12) United States Patent
Terada et al.

(10) Patent No.: US 7,528,311 B2
(45) Date of Patent: May 5, 2009

(54) KEYBOARD-TYPE PERCUSSION INSTRUMENT

(75) Inventors: Norishige Terada, Hamamatsu (JP); Tetsuo Hotta, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/972,280

(22) Filed: Jan. 10, 2008

(65) Prior Publication Data

US 2008/0168885 A1 Jul. 17, 2008

(30) Foreign Application Priority Data

Jan. 11, 2007 (JP) ..... 2007-003505

(51) Int. Cl.
*G10D 13/08* (2006.01)
*G10D 15/00* (2006.01)

(52) U.S. Cl. ..... 84/410; 84/402; 84/403; 84/404; 84/423 R; 84/169

(58) Field of Classification Search ..... 84/402–404, 84/410, 423 R, 189
See application file for complete search history.

(56) References Cited

U.S. PATENT DOCUMENTS 149,232 A * 3/1874 Lincoln ..... 84/404
177,412 A * 5/1876 Matthews ..... 84/170
390,169 A * 9/1888 Hudson ..... 84/189
758,694 A * 5/1904 Riggins ..... 84/189
807,714 A * 12/1905 Beum ..... 84/189
831,852 A * 9/1906 Freeborne ..... 84/189
890,443 A * 6/1908 Norcross ..... 84/178
892,511 A * 7/1908 Fauth ..... 84/189
950,276 A * 2/1910 Clark ..... 84/189
1,121,166 A * 12/1914 Clark ..... 84/189
1,173,507 A * 2/1916 Haskell ..... 84/170
1,891,268 A * 12/1932 Miller ..... 84/404
2,134,680 A * 11/1938 Beck ..... 84/189
2,239,204 A * 4/1941 Socin ..... 84/240
2,300,012 A * 10/1942 Rubinstein ..... 84/174
2,412,212 A * 12/1946 Gerlat ..... 84/189
2,469,667 A * 5/1949 Rhodes ..... 84/404
2,474,462 A * 6/1949 Brewer ..... 84/404
2,641,153 A * 6/1953 Enochs et al. ..... 84/403
2,800,827 A * 7/1957 Haselton ..... 84/404
3,721,148 A * 3/1973 Goss ..... 84/189
3,858,477 A * 1/1975 Kawakami ..... 84/410

(Continued)

FOREIGN PATENT DOCUMENTS

JP 5-81895 11/1993

*Primary Examiner*—Walter Benson
*Assistant Examiner*—Robert W Horn
(74) *Attorney, Agent, or Firm*—Dickstein Shapiro LLP

(57) ABSTRACT

A keyboard-type percussion instrument capable of outputting, with high quality, a musical tone to outside the instrument. In an upper part of the instrument, there is provided a tone generator unit including sounding members disposed to respectively correspond to keys of a keyboard and a resonance box in which musical tones generated by sounding members resonate. Action mechanisms each having a hammer felt for striking a corresponding sounding member are disposed below the tone generator unit. Reflection plates and a keybed formed with tone output ports are disposed below the action mechanisms. A musical tone generated by a sounding member struck by a corresponding hammer felt resonates in the resonance box, is output therefrom, passes through the tone output ports, is reflected by the reflection plates, and is output toward rearward of the instrument.

4 Claims, 12 Drawing Sheets

U.S. PATENT DOCUMENTS 3,981,221 A * 9/1976 Wittel ..... 84/423 R
4,058,044 A * 11/1977 Murakami ..... 84/723
4,211,142 A * 7/1980 Conklin, Jr. ..... 84/189
4,240,321 A * 12/1980 Goldenberg ..... 84/433
4,625,617 A * 12/1986 Hara et al. ..... 84/404
5,235,892 A * 8/1993 Terada et al. ..... 84/404
5,313,867 A * 5/1994 Terada et al. ..... 84/404
2007/0131092 A1 * 6/2007 Terada ..... 84/423 R
2007/0137458 A1 * 6/2007 Terada ..... 84/404
2007/0204743 A1 * 9/2007 Terada ..... 84/423 R
2008/0168885 A1 * 7/2008 Terada et al. ..... 87/404

* cited by examiner

KEYBOARD-TYPE PERCUSSION INSTRUMENT

BACKGROUND OF THE INVENTION

1. Field of the Invention

The present invention relates to a keyboard-type percussion instrument having sounding members each adapted to generate a musical tone when struck.

2. Description of the Related Art

A keyboard-type tone plate percussion instrument has been known, which includes a plurality of keys, hammer actions corresponding to respective ones of the keys, tone plates (sounding members) each adapted to be struck by a corresponding hammer action, and resonance boxes disposed above the tone plates and causing musical tones generated by tone plates to resonate therein (see, for example, Japanese Utility Model Laid-open Publication No. 05-081895). When any of the keys is depressed by a player, a corresponding hammer action strikes a corresponding tone plate, whereby the tone plate vibrates to generate a musical tone of a tone pitch proper to the tone plate.

Some tone plate percussion instruments of this type each have an upper part thereof in which the tone plates, the hammer actions and one of the resonance boxes corresponding to the white keys are disposed, and a lower part thereof in which the tone plates, the hammer actions and another resonance box corresponding to the black keys are disposed. When any of the upper tone plates corresponding to the white keys is struck, a musical tone generated by the struck tone plate resonates in the corresponding upper resonance box and is then output downward therefrom. Since the lower resonance box, tone plates and hammer actions corresponding to the black keys are disposed below the struck upper tone plate, etc., the musical tone output downward from the upper resonance box corresponding to the white keys collides with some of the lower resonance box, tone plates and hammer actions, and is thus difficult to be output outside the instrument with high quality.

SUMMARY OF THE INVENTION

The present invention provides a keyboard-type percussion instrument capable of outputting, with high quality, a musical tone from a resonance box to the outside of the instrument.

According to the present invention, there is provided a keyboard-type percussion instrument comprising a plurality of sounding members each adapted to generate, when struck, a musical tone of a tone pitch proper to each sounding member, a resonance box disposed above the sounding members and having a lower surface thereof which is open, the resonance box being adapted to cause a musical tone generated by each of the sounding members to resonate therein and to be output downward therefrom, keys disposed to correspond to respective ones of the sounding members, action mechanisms disposed below the sounding members to correspond to respective ones of the keys, each of the action mechanisms being adapted to strike a corresponding one of the sounding members in accordance with a motion of a corresponding one of the keys, a keybed disposed below the keys and the action mechanisms and having at least one tone output port through which the musical tone output downward from the resonance box passes, the keybed being adapted to receive loads of the keys and the action mechanisms, and at least one reflection plate disposed below the keybed and adapted to reflect the musical tone having passed through the tone output port toward a predetermined direction, wherein the sounding members are arranged in a one-stage structure, and the action mechanisms are arranged in a one-stage structure to correspond to an arrangement of the sounding members.

In this invention, the reflection plate can be comprised of a first reflection plate adapted to reflect the musical tone having passed through the tone output port and a second reflection plate adapted to reflect the musical tone reflected by the first reflection plate toward the predetermined direction.

The first reflection plate can be fixed to the keybed and a bottom plate, which is disposed below the keybed to face the keybed and forming a bottom surface of the keyboard-type percussion instrument.

The reflection plate can be comprised of one reflection plate having a curved reflection surface.

According to the present invention, a musical tone can be output, with high quality, from the resonance box to the outside of the keyboard-type percussion instrument.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

FIGS. 1A to 1D respectively show in rear view, left side view, front view, and right side view a keyboard-type percussion instrument 10 according to one embodiment of this invention. In the following description, the side of the percussion instrument 10 toward a player is referred to as the front side thereof, and left and right directions thereof are determined in reference to the player facing the percussion instrument 10.

Figure 1A:
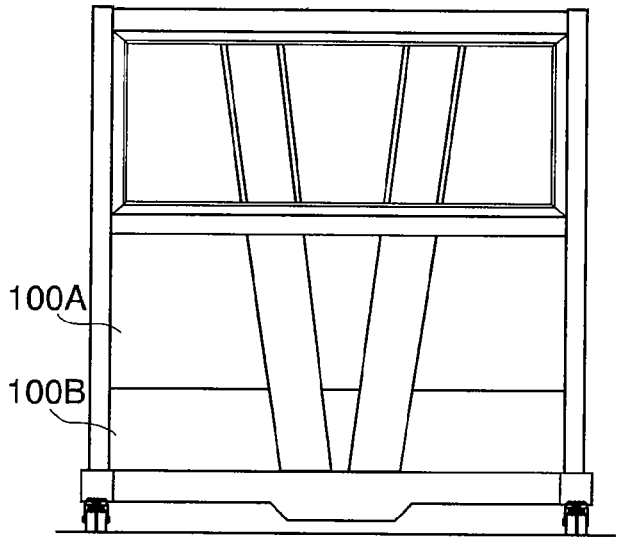
FIG. 1A is a rear view of a keyboard-type percussion instrument according to one embodiment of this invention.
Figure 1B:
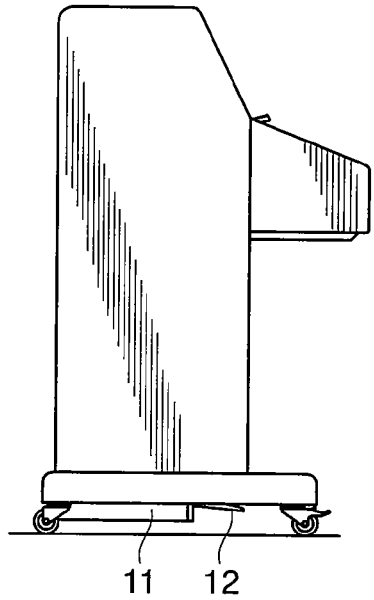
FIG. 1B is a left side view of the percussion instrument.
Figure 1C:
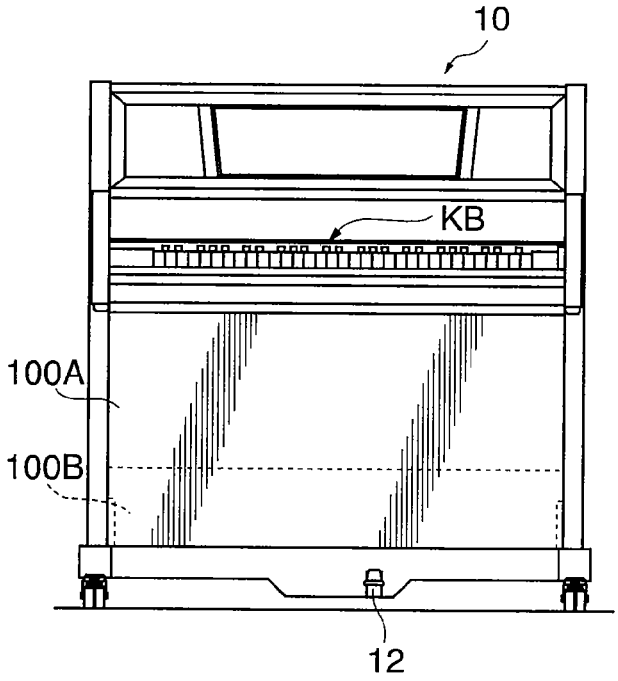
FIG. 1C is a front view of the percussion instrument.
Figure 1D:
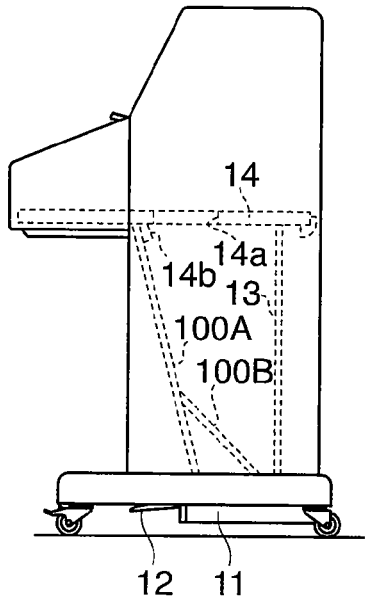
FIG. 1D is a right side view of the percussion instrument.

First, an explanation will be given of the outline of the keyboard-type percussion instrument 10. This percussion instrument 10 is adapted to cause each of metallic sounding members to vibrate to generate a musical tone when the sounding member is struck. As shown in FIGS. 1B and 1C, the percussion instrument 10 includes a keyboard KB having a plurality of white keys and black keys, a damper pedal 12 adapted to be operated by a foot of a player, and a pedal box 11 in which there is provided a mechanism for vertically moving a pedal coupling rod 13 in accordance with a motion of the damper pedal 12. When any of the keys of the keyboard KB is depressed by the player, a corresponding one of the sounding members, which are disposed inside the keyboard-type percussion instrument 10 to correspond to respective ones of the keys, is struck to generate a musical tone. The damper pedal 12 is adapted to control vibration of the sounding members. Specifically, in a state that the damper pedal 12 is stepped on by the player, even if the key is no longer depressed by the player, the corresponding sounding member is not suppressed from vibrating. Thus, a time period for which a musical tone is sounded from the struck sounding member becomes longer as compared to the case where the damper pedal 12 is not stepped on.

The keyboard-type percussion instrument 10 includes first and second reflection plates 100A, 100B for outputting a musical tone generated in the instrument 10 toward rearward of the instrument 10. These plates 100A, 100B are mounted to a lower part of the instrument 10 at predetermined angles.

Figure 2:
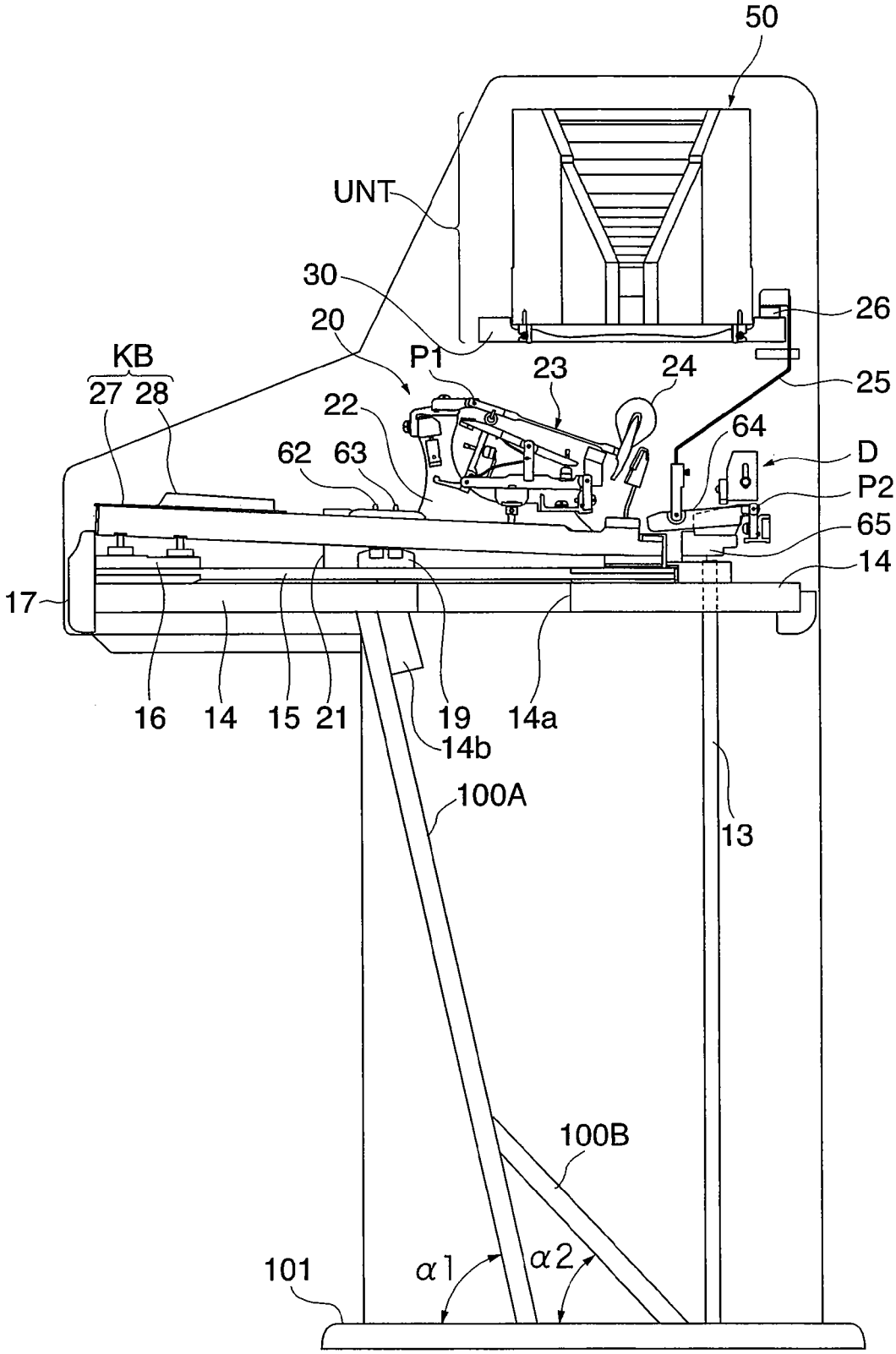
FIG. 2 is a schematic side view showing the interior of the percussion instrument.
Figure 3:
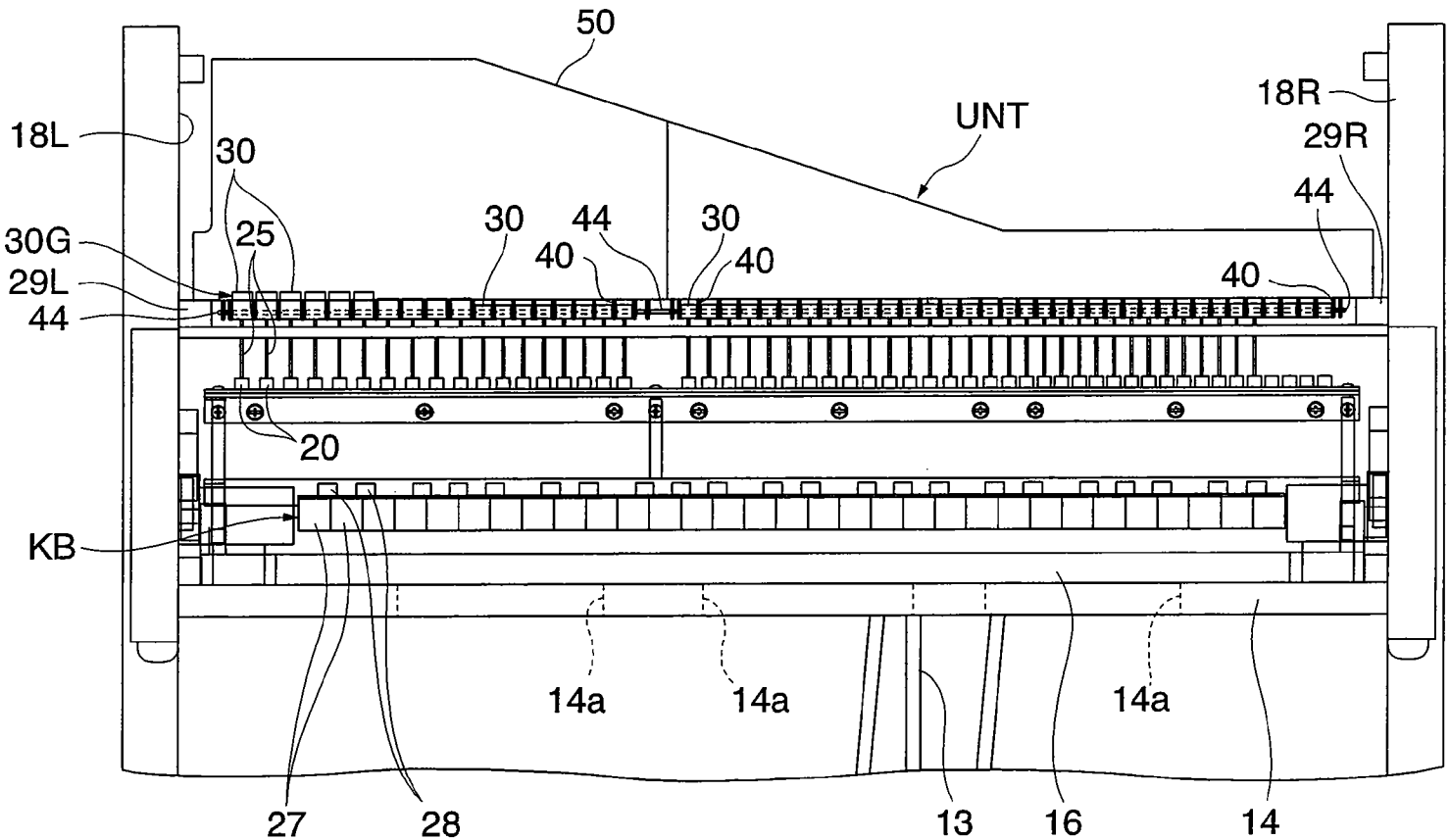
FIG. 3 is a fragmentary front view of the interior of an upper part of the percussion instrument.
Figure 4:
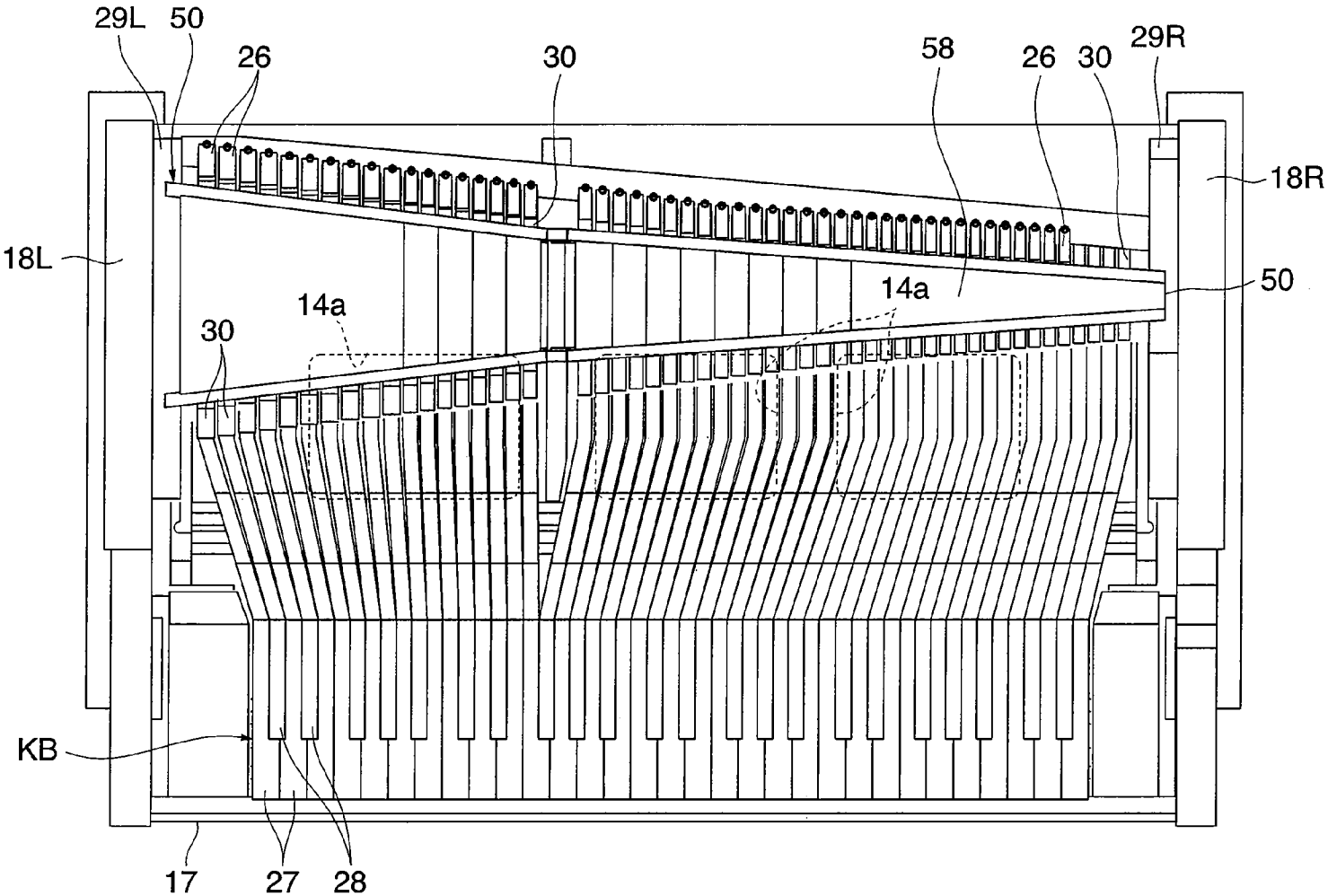
FIG. 4 is a plan view showing the interior of the percussion instrument.

Next, an explanation will be given of the internal construction of the keyboard-type percussion instrument 10. FIGS. 2 to 4 schematically show the interior of the percussion instrument 10 in side view, front view, and plan view. As shown in FIGS. 2 to 4, the percussion instrument 10 has an upper part thereof in which a tone generator unit UNT and a resonance box 50 are disposed. The tone generator unit UNT includes the sounding members 30 disposed to correspond to respective ones of the keys of the keyboard KB and adapted to generate musical tones. The resonance box 50 is adapted to cause a musical tone generated by each sounding member 30 to resonate therein. Furthermore, in the percussion instrument 10, action mechanisms 20 each having a hammer felt 24 for striking the corresponding sounding member 30, and a damper mechanism D for controlling the vibration of the sounding members 30 are disposed below the tone generator unit UNT. The first and second reflection plates 100A, 100B are disposed below the action mechanisms 20.

Figure 5:
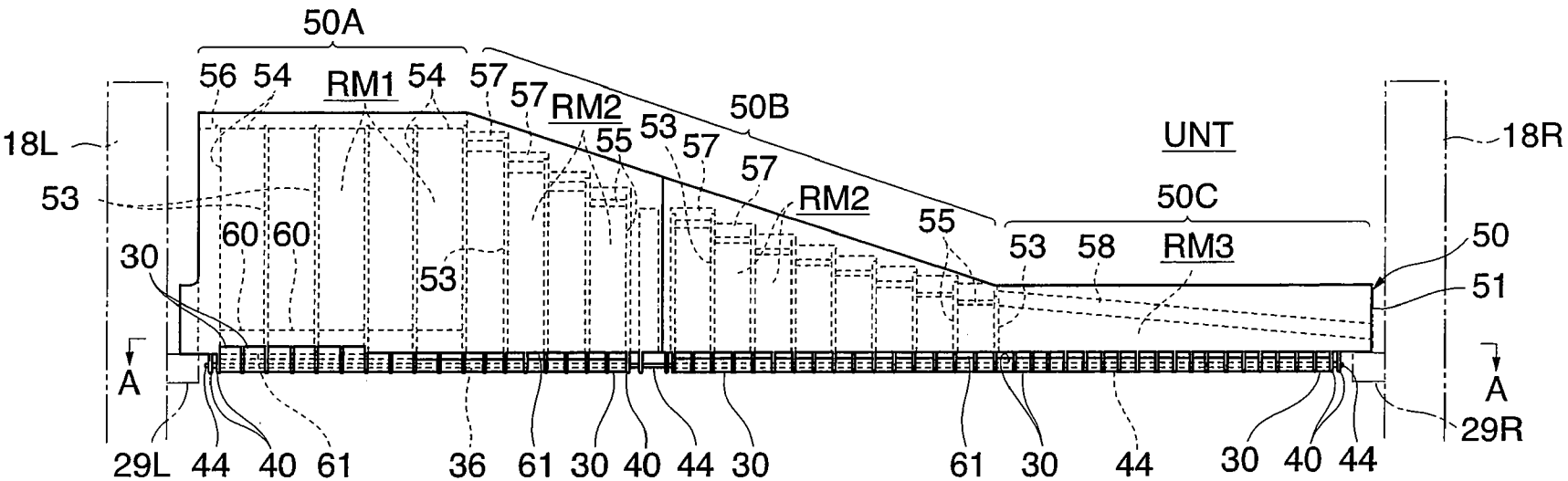
FIG. 5 is a front view of a tone generator unit of the percussion instrument.
Figure 6:
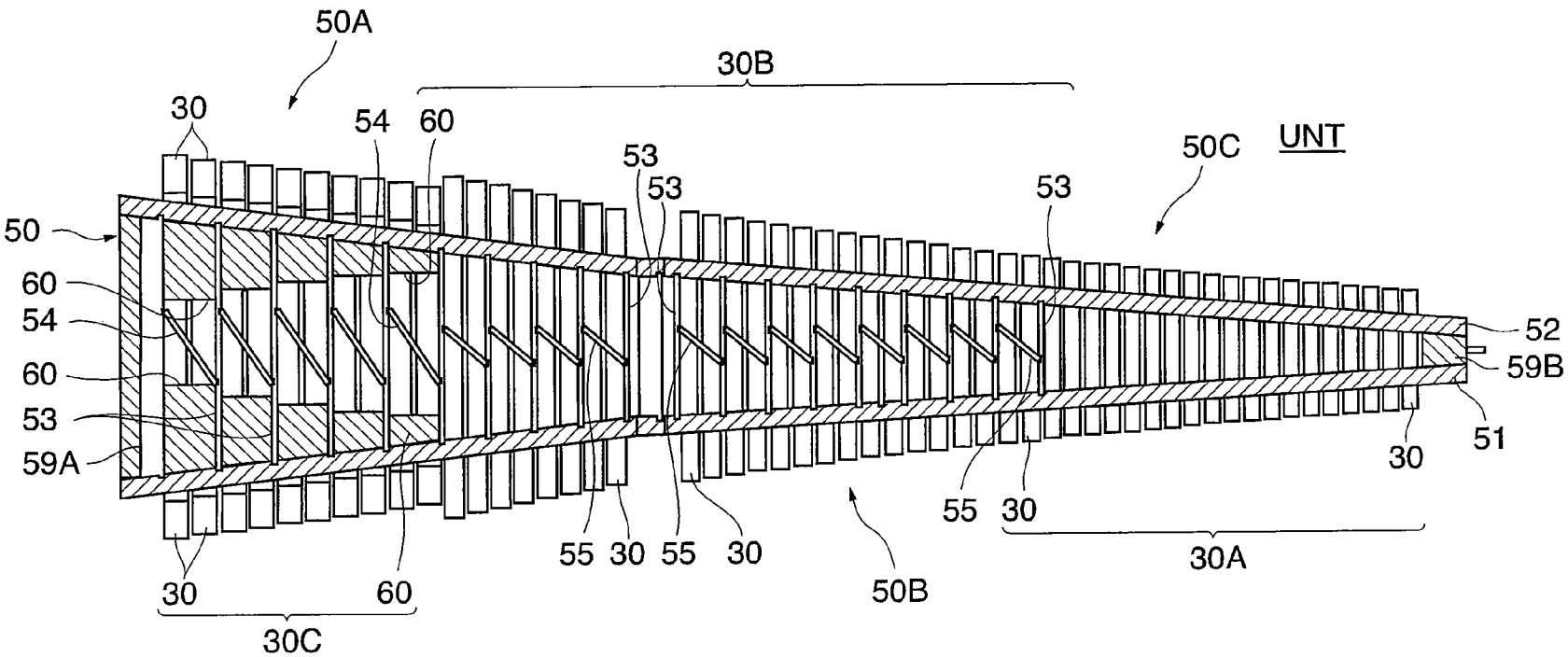
FIG. 6 is a section view taken along line A-A in FIG. 5.
Figure 7:
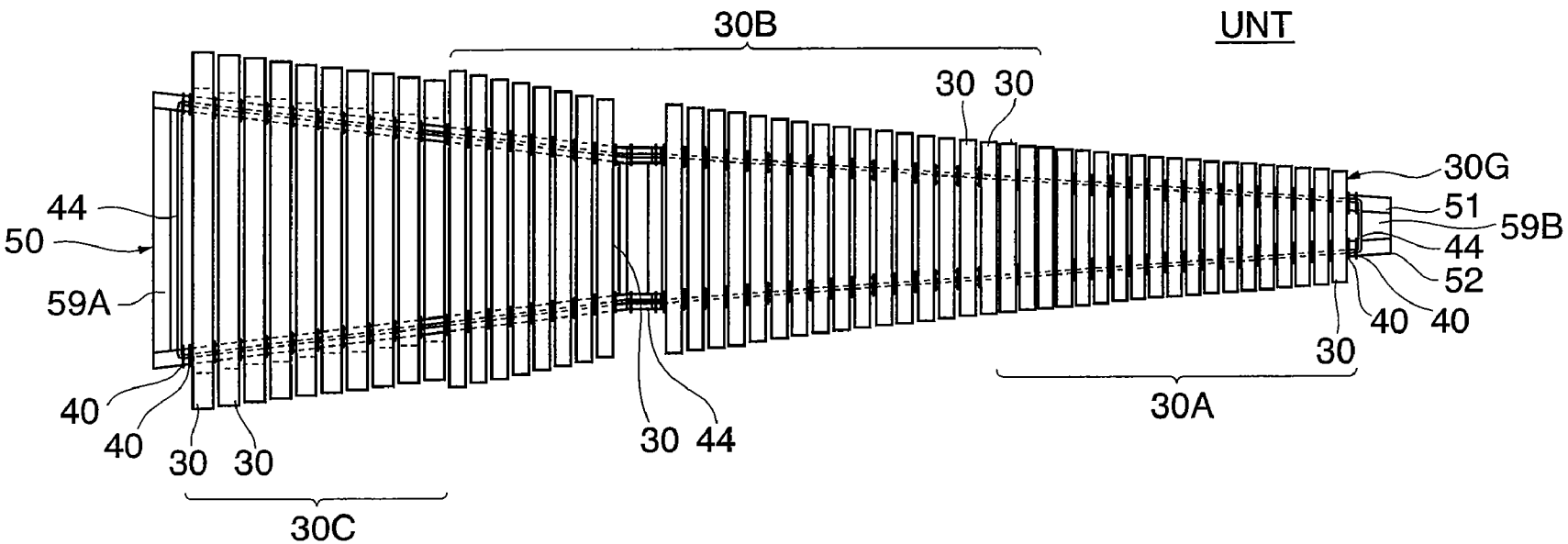
FIG. 7 is a bottom view of the tone generator unit.

First, an explanation will be given of the construction of the tone generator unit UNT. FIG. 5 shows in front view the tone generator unit UNT, FIG. 6 is a section view taken along line A-A in FIG. 5, and FIG. 7 shows in bottom view the tone generator unit UNT. As shown in FIGS. 5-7, the tone generator unit UNT includes the sounding members 30 provided to correspond to respective ones of the keys of the keyboard KB, and the resonance box 50 for causing a musical tone generated by a struck sounding member 30 to resonate therein. In the tone generator unit UNT, opposite end portions of the resonance box 50 are supported at their lower surfaces by supporting portions 29R, 29L respectively extending from right and left side plates 18R, 18L to the inside of the percussion instrument 10. In this embodiment, the sounding members 30 are disposed below the resonance box 50 in the key arrangement direction of the keyboard KB. The sounding members 30 are arranged such that the leftmost and rightmost sounding members 30 as seen from the player are adapted to generate musical tones of the lowest and highest tone pitches, respectively. In this embodiment, the sounding members 30 are arranged in a one-stage structure but not in an upper and lower two-stage structure. The action mechanisms 20 for striking the sounding members 30 are also arranged in a one-stage structure in the key arrangement direction of the keyboard KB.

The sounding members 30 are made of aluminum. The material of the sounding members 30 is not limited to aluminum but may be an aluminum alloy, steel, or some other metal. The sounding members 30 corresponding to respective ones of the keys are different in length, width, and shape from one another. When struck by hammer felts 24, the sounding members 30 vibrate in many different forms to generate musical tones of tone pitches proper to respective ones of the sounding members.

Specifically, as shown in FIG. 7, the sounding members 30 are divided into three sounding member groups 30A, 30B and 30C respectively belonging to high-, mid-, and low-pitch ranges. The sounding members 30 belonging to the group 30A are short in length in the longitudinal direction (forward-to-backward direction). The sounding members 30 belonging to the group 30B are longer in longitudinal length, and those members which belong to the group 30C are much longer in longitudinal length. The sounding members belonging to the group 30C are broad in width, and the sounding members 30 belonging to the group 30A are narrower in width than those belonging to the group 30C. It should be noted that the sounding members belonging to the same pitch range are the same in width from one another.

Figure 8A:
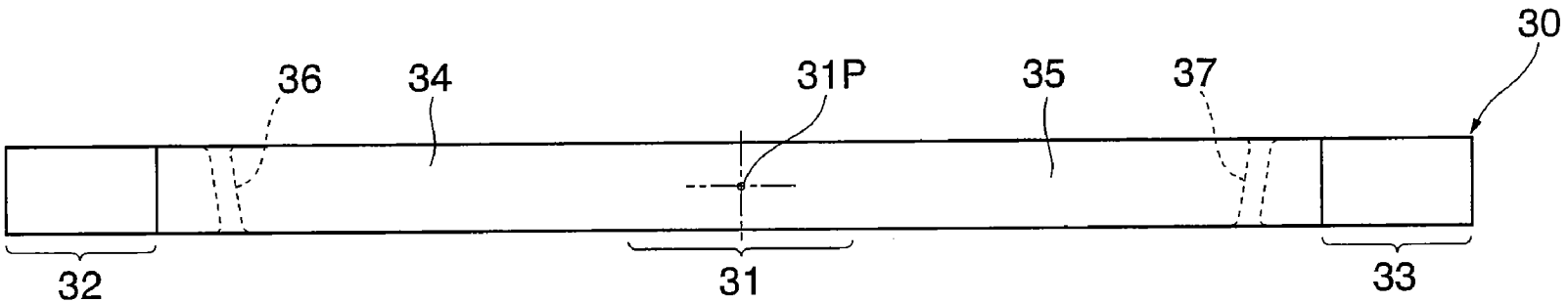
FIG. 8A is a plan view of one of sounding members of the tone generator unit.
Figure 8B:
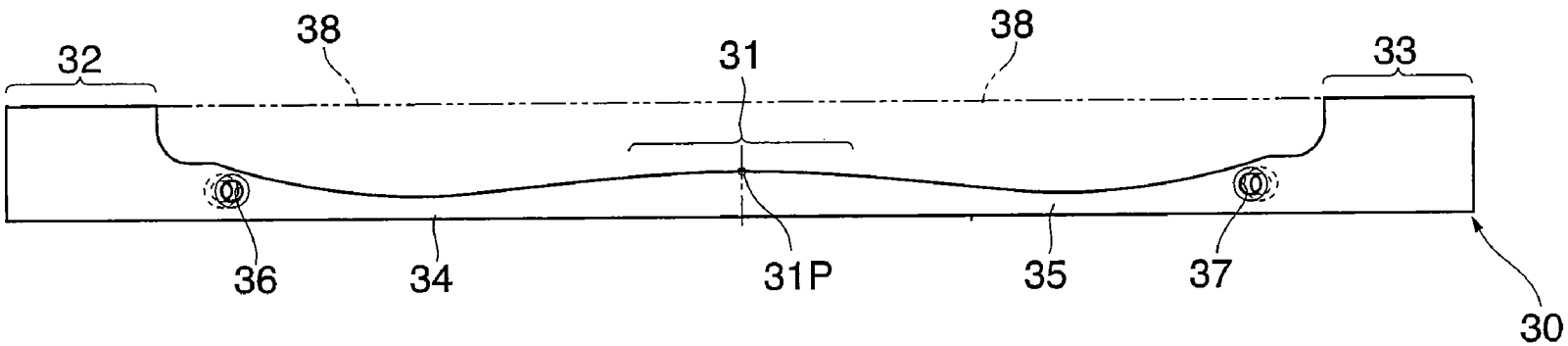
FIG. 8B is a side view of the sounding member.

FIGS. 8A and 8B show in plan view and right side view one of the sounding members 30 belonging to the sounding member group 30C (low-pitch range). This sounding member 30 has a lower surface thereof formed into a flat surface (adapted to be struck by the hammer felt 24) and front and rear end portions 32, 33 thereof thicker than an antinode portion 31 thereof (a longitudinally central portion of the sounding member where a vibration antinode can be formed). The sounding member 30 further includes first and second thinner portions 34, 35. The first thinner portion 34 is thinner than the antinode portion 31 and formed between the antinode portion 31 and the front end portion 32. The second thinner portion 35 is thinner than the antinode portion 31 and formed between the antinode portion 31 and the rear end portion 33. The center of the antinode portion 31 corresponds in position to the antinode center of vibration (hereinafter referred to as the "antinode center 31P").

Figure 9A:
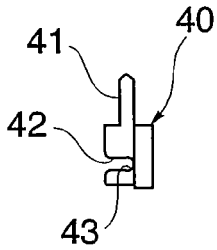
FIG. 9A is a side view of one of fasteners used for mounting the sounding members to a resonance box of the tone generator unit.
Figure 9B:
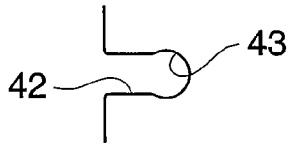
FIG. 9B is a fragmentary enlarged view of the fastener.
Figure 9C:
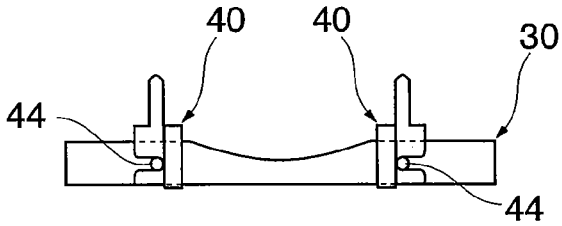
FIG. 9C is a side view of one of sounding members corresponding to a high-pitch range portion of the resonance box.
Figure 9D:
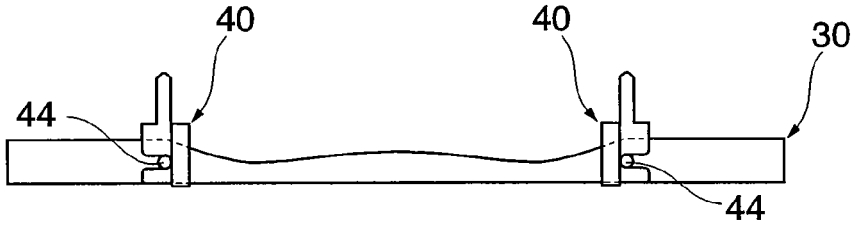
FIG. 9D is a side view of one of sounding members corresponding to a mid-pitch range portion of the resonance box.
Figure 9E:
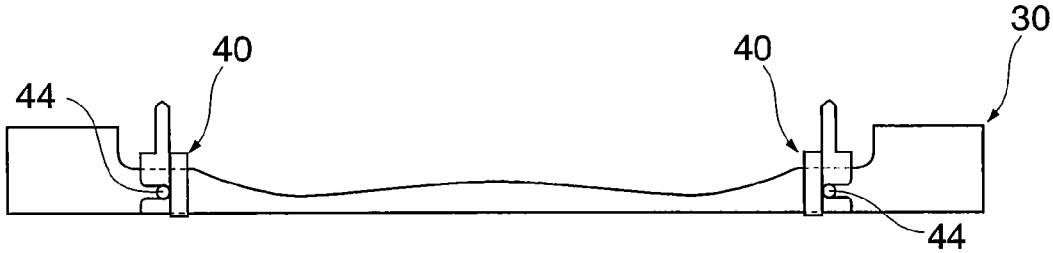
FIG. 9E is a side view of one of sounding members corresponding to a low-pitch range portion of the resonance box.

FIGS. 9C, 9D, and 9E show in side views sounding members 30 belonging to the sounding member groups 30A, 30B, and 30C, respectively. As shown in FIGS. 9C, 9D, and 9E, the sounding members 30 belonging to the groups 30A, 30B each have front and rear end portions 32, 33 thereof thinner than those of sounding members 30 belonging to the group 30C. The sounding members 30 belonging to the group 30A are not formed with portions corresponding to the first and second thinner portions 34, 35.

As shown in FIGS. 8A and 8B, the sounding member 30 is formed with supporting holes 36, 37 that extend therethrough at positions closer to the end portions of the sounding member than to the longitudinally central portion thereof. Vibration nodes can be formed in these positions. The sounding member 30 effectively generates a musical tone when caused to vibrate in a state where it is supported at the supporting holes 36, 37. As illustrated, the supporting holes 36, 37 each extend obliquely relative to the width direction of the sounding member 30 and not parallel to the width direction thereof.

Next, an explanation will be given of the construction of the resonance box 50 in which tones generated by sounding members 30 resonate. The resonance box 50 is formed into a box shape having an open lower surface, and has its front common wall 51 forming a front surface thereof, a rear common wall 52 forming a rear surface thereof, side walls 59A, 59B forming left and right side surfaces thereof, and lid members 56, 57 and 58 closing an upper surface thereof. As shown in FIG. 5, the resonance box 50 is divided into low-, mid-, and high-pitch range portions 50A, 50B, and 50C. The low-pitch range portion 50A includes Helmholtz type resonance chambers RM1, which are the same in number as sounding members 30 disposed below the low-pitch range portion 50A and which are arranged to correspond to these sounding members 30. The mid-pitch range portion 50B of the resonance box 50 includes closed-tube type resonance chambers RM2, which are the same in number as sounding members 30 disposed below the mid-pitch range portion 50B and arranged to correspond to these sounding members 30. The high-pitch range portion 50C includes a single-type resonance box in which one resonance chamber RM3 is provided, which is common to sounding members 30 disposed below the high-pitch range portion 50C.

Each of the front and rear common walls 51, 52 of the resonance box 50 is comprised of a plate-like member having two rectangular portions thereof corresponding to the low- and high-pitch range portions 50A, 50C of the resonance box 50 and a trapezoidal portion thereof corresponding to the mid-pitch range portion 50B of the resonance box 50, as shown in FIG. 5. The rectangular portion of each wall 51 or 52 corresponding to the low-pitch range portion 50A of the box 50 is larger in vertical height than another rectangular portion thereof corresponding to the high-pitch range portion 50C of the box 50. In the trapezoidal portion of each common wall of the resonance box 50, which corresponds to the mid-pitch range portion 50B of the box 50, the vertical height on the low-pitch range portion 50A side is higher than that on the high-pitch range portion 50C side. As shown in FIG. 6, the distance between the front and rear common walls 51, 52 disposed in a facing relation becomes narrower toward the right side (in which the sounding members 30 for high-pitch range are disposed) and becomes broader toward the left side (in which the sounding members 30 for low-pitch range are disposed).

As shown in FIG. 6, in the low- and mid-pitch range portions 50A, 50B of the resonance box 50, a plurality of partition plates 53 are provided between the front and rear common walls 51, 52. The partition plates 53 each comprised of a flat plate are fixed between the front and rear common walls 51, 52 and extend in parallel to one another in the forward-to-backward direction. The distance between each adjacent two of the partition plates 53 is made slightly larger than the total width of two sounding members 30 disposed therebelow. On the low-pitch range portion 50A side, the distance between the partition plates 53 becomes larger than that on the mid-pitch range portion 50B since the width of sounding members 30 differs from that of the sounding members 30 disposed below the mid-pitch range portion 50B.

In the high-pitch range portion 50C of the resonance box 50, the resonance chamber RM3 is defined by a partition plate 53 disposed between the mid- and high-pitch range portions 50B, 50C, the front and rear common walls 51, 52, and the lid member 58 closing an upper part of the high-pitch range portion 50C. As shown in FIG. 4, the lid member 58 is comprised of a plate-like member of a trapezoidal shape. The lid member 58 is connected to front and rear common walls 51, 52 and the side wall 59B so as to obliquely extend rightwardly and downwardly from the mid-pitch range portion 50B side, as shown in FIGS. 5 and 6.

In the mid-pitch range portion 50B, a space defined by each adjacent two of the partition plates 53 is divided by an inclined plate 55, which is comprised of a flat plate. The inclined plate 55 is connected to central portions of the two partition plates 53 in the forward-to-backward direction and extends obliquely as seen from above, thereby defining two resonance chambers RM2 in the space defined by the each adjacent two of the partition plates 53. In the mid-pitch range portion 50B, a lid member 57 for each of spaces defined by the partition members 53 is connected to upper portions of the partition plates 53 and the front and rear common walls 51, 52 so as to close an upper part of the space.

Figure 10:
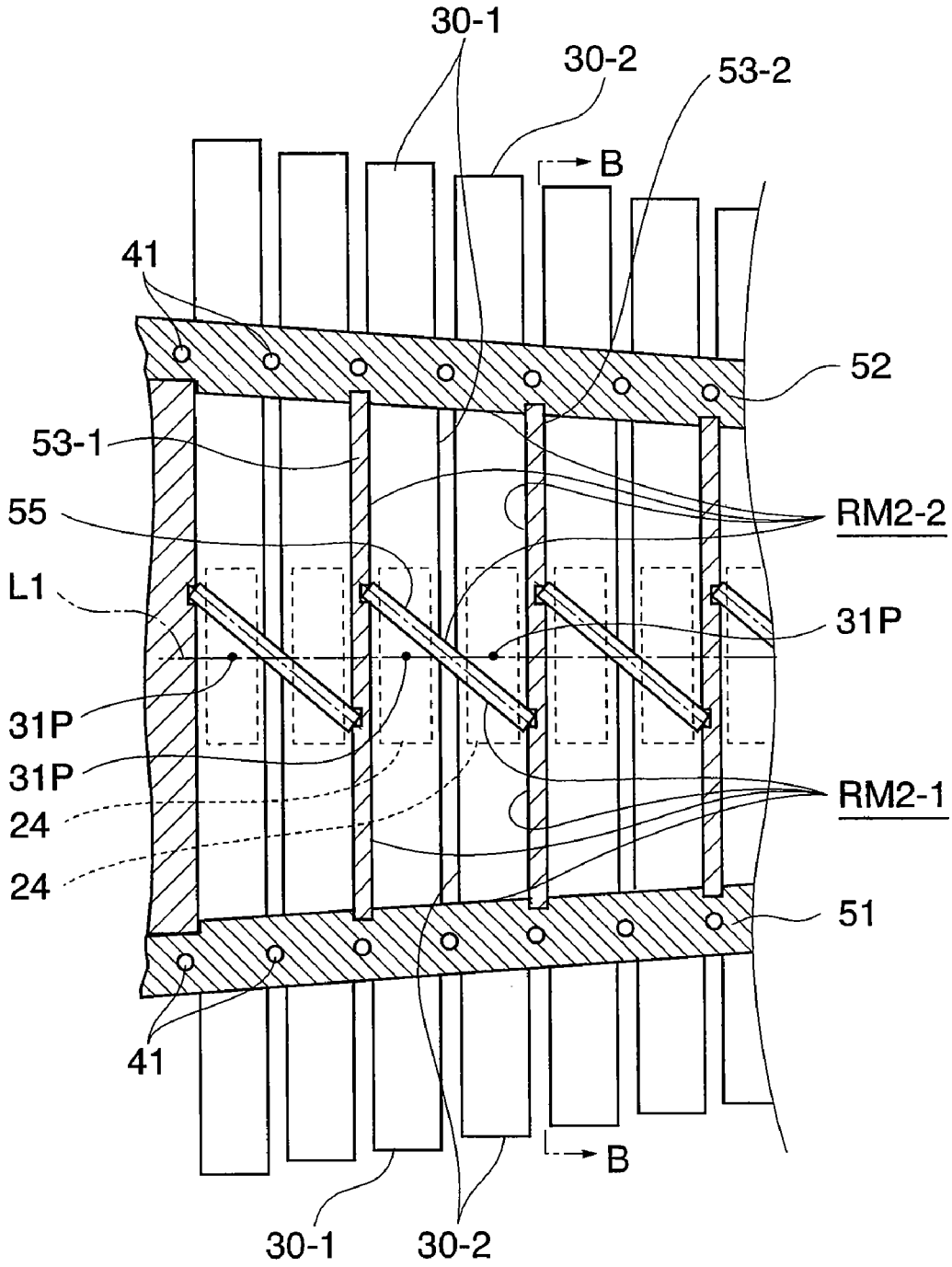
FIG. 10 is a fragmentary enlarged view of the mid-pitch portion shown in FIG. 6.

FIG. 10 shows in fragmentary enlarged view the mid-pitch range portion 50B of the resonance box 50 shown in FIG. 6. For discrimination, in FIG. 10, suffix numeral 1 is attached to one of two resonance chambers RM2 defined between each adjacent two of the partition plates 53, and suffix numeral 2 is attached to another of them. The resonance chamber RM2-1 is disposed on the front side of the resonance box 50, and the resonance chamber RM2-2 is disposed on the rear side thereof. To discriminate each adjacent two sounding members 30 disposed below the resonance chambers RM2-1, RM2-2 which are four in total, suffix numeral 1 is attached to one of the sounding members 30 and suffix numeral 2 is attached to the other thereof. To discriminate each adjacent two partition plates 53 defining the four resonance chambers RM2-1, RM2-2, suffix numeral 1 is attached to one of the partition plates 53 and suffix numeral 2 is attached to the other thereof.

In FIG. 10, positions of hammer felts 24 that strike sounding members 30 are shown by dotted lines. When any of the hammer felts 24 strikes the corresponding sounding member 30, the center position of a contact surface of the hammer felt 24 coincides with the position of the antinode center 31P of the sounding member 30 concerned. The antinode centers 31P of all the sounding members 30 are positioned on an imaginary straight line L1 passing through regions of all the resonance chambers RM1 to RM3. The antinode centers 31P of all the sounding members 30 are the same in position as viewed in the forward-to-backward direction. The antinode center 31P of each sounding member 30-1 is located below the resonance chamber RM2-1, and the antinode center 31P of each sounding member 30-2 is located below the resonance chamber RM2-2. In this way, the antinode center 31P of each sounding member 30 is located below the opening portion of the corresponding resonance chamber. Therefore, a musical tone generated when any of the sounding members 30-1 is struck by the corresponding hammer felt 24 resonates in the corresponding resonance chamber RM2-1, whereas a musical tone generated when any of the sounding members 30-2 is struck resonates in the corresponding resonance chamber RM2-2.

In this embodiment, each of the resonance chambers corresponding to respective ones of the sounding members 30 has its width nearly two times the width of the corresponding sounding member 30. Thus, it is ensured that a resonance chamber having a broad width is provided for each sounding member 30, making it possible to realize satisfactory resonance. In addition, only the width equal to the total width of two sounding members 30 is required for the provision of two resonance chambers, while ensuring that each of the resonance chambers for respective sounding members 30 can have a broad width. Thus, the entire width of the resonance box 50 in the left-to-right direction can be suppressed from increasing, making it possible to arrange the sounding members 30 in a one-stage structure.

Also in the low-pitch range portion 50A of the resonance box 50, a space defined between each adjacent two partition plates 53 is divided by an inclined plate 54, as in the case of the mid-pitch range portion 50B. The inclined plate 54, which is formed by a flat plate, extends obliquely relative to the partition plates 53 as seen from above, and is connected to central portions of these two partition plates 53, whereby two resonance chambers RM1 are defined in the space between each adjacent two partition plates 53. In the low-pitch range portion 50A in which the distance between each adjacent two partition plates 53 differs from that in the mid-pitch range portion 50B, an inclination angle of the inclined plate 54 relative to the two partition plates 53 differs from that of the inclined plate 55 relative to the partition plates 53. In the low-pitch range portion 50A of the resonance box 50, port-forming members 60 are provided on the front and rear common wall 51, 52 sides in a lower portion of each of resonance chambers RM1. Each port-forming member 60 is formed by a flat plate. Each of the port-forming members 60 on the front side is horizontally connected to the front common wall 51 and each adjacent two partition plates 53 disposed on the both sides of the resonance chamber RM1 concerned. Each of the port-forming members 60 on the rear side is horizontally connected to the rear common wall 52 and two partition plates 53 disposed on the both sides of the resonance chamber RM1.

Each resonance chamber RM1 is provided at its opening portion with a port, which is formed by the two partition plates 53 disposed on the both sides of the resonance chamber RM1, the inclined plate 54, and the port-forming member 60. In a Helmholtz-type resonance box, a musical tone resonating therein has a tone pitch that is generally affected by the length and sectional area of the port as well as the volume of the resonance box. For example, the tone pitch at which a musical tone resonates in the resonance box decreases with the increase in port length and with the decrease in port sectional area even when the volume of the resonance box is kept unchanged. In this embodiment, the port-forming member 60 is formed into a shape that is appropriately determined to adjust the length and sectional area of the port of each resonance chamber RM1 so that a musical tone generated by the corresponding sounding member 30 can satisfactorily resonate in the resonance chamber RM1.

Figure 11:
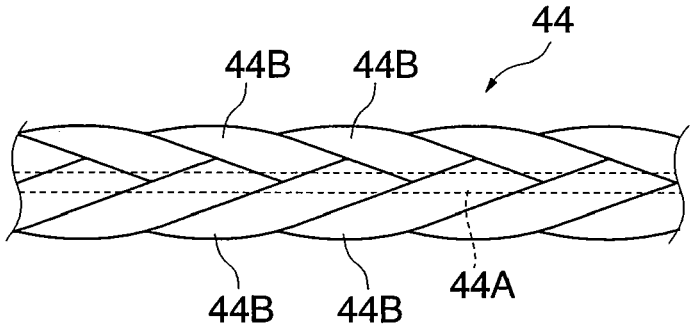
FIG. 11 is an external view of a supporting cord used for mounting the sounding members to the resonance box.

Next, an explanation will be given of the construction in which the sounding members 30 are arranged in a lower part of the resonance box 50. FIG. 11 shows an external appearance of a supporting cord 44, which is used for supporting the sounding members 30 below the resonance box 50. The supporting cord 44 is comprised of a core string 44A and a cord 44B wound around the core string 44A, and is formed into a circular shape in cross section. The core string 44A is made of nylon. The cord 44B is made of artificial leather having a suede-like surface and a softness similar to that of deerskin. Specifically, the cord 44B is comprised of a string-shaped nonwoven fabric comprised of intertwined ultrafine fibers. The cord 44B is wound around the core string 44A with no space between turns of the cord to cover the core string 44A.

In mounting the sounding members 30 below the resonance box 50, the sounding members 30 are first brought together using the supporting cord 44. Specifically, the sounding members 30 are first arranged in the order of tone pitch in the left-to-right direction. The sounding member 30 for the lowest pitch tone is arranged on the leftmost side, whereas the sounding member 30 for the highest pitch tone is arranged on the rightmost side.

Next, the supporting cord 44 is inserted from left to right through the front supporting hole 36 of the leftmost sounding member 30. After inserted through the front supporting hole 36 of the leftmost sounding member 30, the cord 44 is inserted through the front supporting hole 36 of the right-hand neighbor of the leftmost sounding member 30. In this way, the supporting cord 44 is sequentially inserted through the front supporting holes 36 of all the sounding members 30 arranged in the order of tone pitch.

After inserted through the front supporting holes 36 of all the sounding members 30, the supporting cord 44 is inserted from right to left through the rear supporting hole 37 of the rightmost sounding member 30. After inserted through the rear supporting hole 37 of the rightmost sounding member 30, the cord 44 is inserted through the rear supporting hole 37 of the left-hand neighbor of the rightmost sounding member 30. The supporting cord 44 is sequentially inserted through the rear supporting holes 37 of all the sounding members 30 arranged in the order of tone pitch.

After inserted through the front and rear supporting holes 36, 37 of all the sounding members 30, the both ends of the supporting cord 44 are tied together. By tying the both ends of the cord 44 together, all the sounding members 30 are brought together in the order of tone pitch.

Next, a plurality of fasteners 40 adapted to retain the supporting cord 44 below the resonance box 50 are mounted to the resonance box 50. FIG. 9A shows one of the fasteners 40 in side view and FIG. 9B shows the fastener 40 in fragmentary enlarged view. The fastener 40 is made of metal and includes a cord receiving portion 43 for retaining the supporting cord 44, a groove 42 through which the cord 44 passes through upon being inserted into the cord receiving portion 43, and a pin portion 41 adapted to be pressed into the resonance box 50. The cord receiving portion 43 is formed into a circular shape having an inner diameter thereof approximately equal to the diameter of the supporting cord 44. The groove 42 has its width slightly smaller than the diameter of the supporting cord 44. As a result, the supporting cord 44 inserted into the cord receiving portion 43 is not easily dismounted from the fastener 40.

The pin portion 41 of each fastener 40 is pressed into the front or rear common wall 51 or 52 of the resonance box 50. Each fastener 40 is pressed into the front common wall 51 with an opening portion of the groove 42 directed forward, or pressed into the rear common wall 52 with the opening portion of the groove 42 directed rearward. The distance between positions on the front or rear common wall in which pin portions 41 of each adjacent two fasteners 40 are pressed is larger than the width of the sounding member 30. As shown by way of example in FIG. 10, in the mid-pitch range portion 50B of the resonance box 50, the pin portion 41 of each fastener is pressed into the front or rear common wall at a position located on an imaginary extension line of the longitudinal axis of the partition plate 53 or on an imaginary line passing through an intersection of the inclined plate 55 and the imaginary line L1 and extending perpendicular to the line L1. In the low-pitch range portion 50A of the resonance box 50, the pin portion 41 of each fastener 40 is pressed into the front or rear common wall at a position similar to that in the mid-pitch range portion 50B. In the high-pitch range portion 50C, the pin portions 41 of the fasteners are pressed into the common walls, with a distance slightly wider than the width of the sounding member 30.

After the fasteners 40 have been pressed into the resonance box 50, the box 50 is turned with its lower surface facing up, and the sounding members 30 tied together by the supporting cord 44 are placed on the opening portion of the resonance box 50. Then, each adjacent sounding members 30 are moved apart to provide a gap therebetween, and the supporting cord 44 visible from between the sounding members 30 is inserted into the groove 42 of each fastener 40 and hung on the cord receiving portion 43 thereof. At that time, the supporting cord 44 is hung on the cord receiving portions 43 of the fasteners 40 such that one sounding member 30 is located between each adjacent two of the fasteners 40. After the supporting cord 44 is hung on the fasteners 40, the resonance box 50 is turned with its opening portion facing down.

Figure 12:
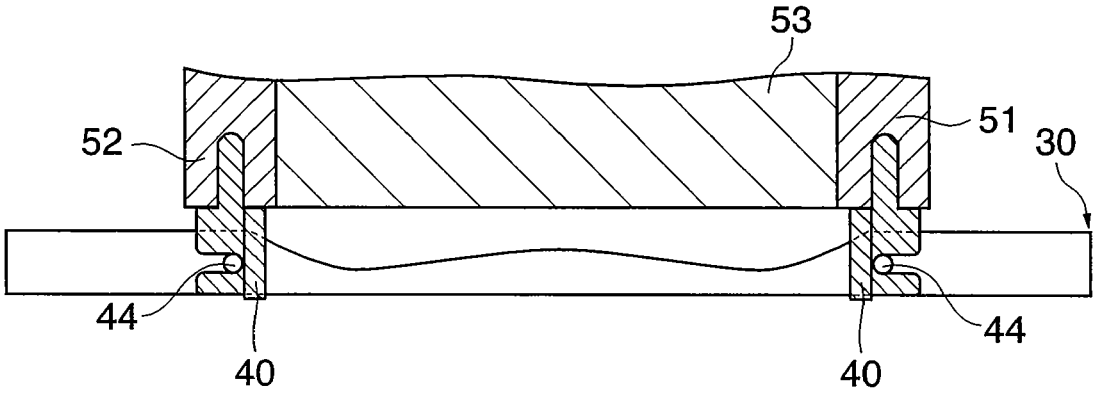
FIG. 12 is a fragmentary section view taken along line B-B in FIG. 10.

FIG. 12 is a section view taken along line B-B in FIG. 10. In a state that the opening portion of the resonance box 50 is directed downward, the supporting cord 44 is supported by the cord receiving portions 43 of the fasteners 40 at locations below the resonance box 50, as shown in FIG. 12. Since the supporting cord 44 is inserted through the supporting holes 36, 37 of the sounding members 30, these sounding members 30 are supported by the cord 44 so as to be suspended therefrom and capable of vibrating at locations below and in the vicinity of the opening portion of the resonance box 50.

Next, an explanation will be given of various parts of the percussion instrument 10 disposed below the tone generator unit UNT. As shown in FIGS. 2 to 4, between right and left side plates 18R, 18L forming opposite side surfaces of the percussion instrument 10, there is horizontally disposed a keybed 14 having three tone output ports 14*a* through which musical tones generated downward from the resonance box 50 pass. A key frame 15 is disposed on the keybed 14, a front rail 16 is disposed in front of the key frame 15, and a front portion of the front rail 16 is covered by a keyslip 17. On the key frame 15, balance rails 19 are disposed to correspond to respective ones of the white and black keys 27, 28 of the keyboard KB. The balance rails 19 are for supporting the white and black keys 27, 28 and provided with balance pins 62, 63. Each of the keys is supported by a corresponding balance rail 19 such that longitudinal end portions thereof are vertically pivotable around the balance pins 62, 63 as fulcrum.

On the key frame 15, action brackets 22 for supporting the action mechanisms 20 are disposed to correspond to respective ones of the keys. The action mechanisms 20 are the same in construction as those of a grand piano which strike strings provided therein. Each action mechanism 20 includes a hammer shank 23 adapted to be pivotable clockwise or counterclockwise around a fulcrum P1 in accordance with movement of a corresponding key of the keyboard KB, and a hammer felt 24 provided at a tip end of the hammer shank 23 for striking the corresponding sounding member 30.

On the rear side of the instrument 10, pivotal members 64 are disposed above the keybed 14 to correspond to respective ones of the keys of the keyboard KB. Damper wires 25 having damper felts 26 are attached to the pivotal members 64 to be pivotable clockwise or counterclockwise around fulcrums P2 shown in FIG. 2 in accordance with motions of the keys.

On the rear side of the percussion instrument 10, a pushing member 65 is disposed below the pivotal members 64. The pushing member 65 is in contact with the pedal coupling rod 13 coupled to the damper pedal 12 and vertically movable with a vertical motion of the pedal coupling rod 13. The pushing member 65 disposed in contact with all the pivotal members 64 causes all these pivotal members 64 to be pivoted in accordance with an upward and downward motion of the pedal coupling rod 13.

The keybed 14 has a lower surface formed with a projection 14*b* to which the first reflection plate 100A is attached. Below the tone output ports 14*a*, the first and second reflection plates 100A, 100B are disposed. Each of the first and second reflection plates 100A, 100B is formed by a flat plate made of lauan plywood whose surface is covered by a decorative sheet of oak. In this embodiment, each reflection plate has a thickness of 14 mm. The first reflection plate 100A is fastened to the projection 14*b* of the keybed 14 and a bottom plate 101 of the instrument 10 using screws, not shown. The second reflection plate 100B is fastened at its upper and lower parts to the first reflection plate 100A and the bottom plate 101, using screws, not shown. In this embodiment, as shown in FIG. 2, an angle $\alpha$1 formed between the bottom plate 101 and the first reflection plate 100A is larger than an angle $\alpha$2 formed between the bottom plate 101 and the second reflection plate 100B.

In this embodiment, as shown in FIG. 1, the length of the first reflection plate 100A in the left-to-right direction is equal to the distance between inner surfaces of the right and left side plates 18R, 18L forming side surfaces of the instrument 10, and the length of the first reflection plate 100A in the vertical direction is longer than the distance between the keybed 14 and the bottom plate 101. In a state that the first reflection plate 100A is connected to the projection 14*b* and the bottom plate 101, the first reflection plate 100A supports the keybed 14 and prevents the right and left side plates 18R, 18L from being inclined in the left-to-right direction.

In a state that the first and second reflection plates 100A, 100B are mounted, a space below the keybed 14 is divided by these plates 100A, 100B into two in the forward-to-rearward direction. An upper part of the pedal box 11 is covered by the first and second reflection plates 100A, 100B such that the interior of the pedal box 11 is made invisible from outside. The angle $\alpha$1 is set to a value falling within a rage from 70 to 80 degrees, and the angle $\alpha$2 is set to a value falling within a range from 30 to 60 degrees, preferably, within a range from 40 to 50 degrees.

According to the above described construction, when any of the keys of the keyboard KB is depressed by the player, the rear end portion of the depressed key is moved upward and the pivotal member 64 corresponding thereto is pivoted clockwise in FIG. 2. On the other hand, when the damper pedal 12 is not stepped on and none of the keys is depressed, the damper felts 26 are in contact with the sounding members 30, as shown in FIG. 2. When one of the pivotal members 64 is pivoted clockwise as mentioned above, the corresponding damper wire 25 is moved upward and the damper felt 26 is made out of contact with the sounding member 30. When any of the keys is depressed downward, the corresponding action mechanism 20 causes the hammer shank 23 to be pivoted counterclockwise and the hammer felt 24 strikes the sounding member 30. When struck by the hammer felt 24, the sounding member 30 vibrates since the damper felt 26 is kept apart from the sounding member 30 at that time.

Subsequently, when the player's finger is taken off the depressed key, the rear end portion of the key is moved downward, and the action mechanism 20 causes the hammer shank 23 to be pivoted clockwise, so that the hammer felt 24 is moved away from the sounding member 30. In accordance with the motion of the rear end portion of the key, the pivotal member 64 is pivoted counterclockwise. As a result, the damper wire 25 is moved downward and the damper felt 26 is made in contact with the sounding member 30, whereby the sounding member 30 is suppressed from vibrating.

When the damper pedal 12 is stepped on, the pedal coupling rod 13 is moved upward, and the pushing member 65 causes all the pivotal members 64 to be pivoted clockwise around the fulcrums P2. Thus, the damper wires 25 are moved and all the damper felts 26 corresponding to respective ones of the keys are moved apart from the sounding members 30. When the damper pedal 12 is stepped on to cause the pivotal members 64 to be pivoted clockwise, the rear end portions of the keys are made out of contact with the pivotal members 64 and a sounding member 30 corresponding to a depressed key is not suppressed from vibrating by the damper felt 26, even if the player's finger is taken off the depressed key.

A musical tone generated from a struck and vibrating sounding member 30 resonates in the resonance box 50 and is output downward therefrom. The musical tone output from the resonance box 50 passes through the tone output ports 14*a* located below the action mechanisms 20 to below the keybed 14, and is reflected by the first reflection plate 100A. Then, the musical tone is reflected by the second reflection plate 100B and is then output toward rearward of the instrument 10. Alternatively, the musical tone directed to below the keybed 14 is reflected by the second reflection plate 100B without being reflected by the first reflection plate 100A, and is output toward rearward of the instrument 10.

In this embodiment where the sounding members 30 and the action mechanisms 20 are arranged in a one-stage structure below the resonance box 50, there are less obstructions to intercept a musical tone output downward from the resonance box 50 than in a keyboard-type tone plate percussion instrument where sounding members are arranged in a two-stage construction. Thus, musical tones output from the resonance box 50 can be output to the outside of the instrument 10, with high quality.

In this embodiment, a musical tone output from the resonance box 50 is reflected by the first and/or second reflection plates 100A, 100B and output toward rearward of the instrument 10. Thus, musical tones are heard by listeners with a feeling of a spread of sound into space.

In the embodiment, the keyboard KB, the action mechanisms 20, the tone generator unit UNT and the like are disposed above the keybed 14, and thus the center of gravity of the instrument 10 is located at an upper part of the instrument 10. However, the first reflection plate 100A between the right and left side plates 18R, 18L supports the keybed 14 and the side plates 18R, 18L, and therefore, the resultant structure has a higher strength as compared to a structure not having such a reflection plate.

In this embodiment, an upper part of the pedal box 11 is covered by the first and second reflection plates 100A, 100B. However, these reflection plates simply fastened to the instrument 10 using screws can easily be dismounted therefrom, making it easy to perform an adjustment of the mechanism disposed inside the pedal box 11.

In the above, one embodiment of this invention has been described. This invention is not limitative to the above described embodiment and can be embodied in other forms. For example, this invention can be embodied according to a modification of the embodiment, described below.

The first and second reflection plates 100A, 100B may be made of any material other than lauan plywood so long as it has the same thickness as and the same or greater strength than the lauan plywood. Especially, in the case that the reflection plates are made of a material thinner in thickness and smaller in density than lauan plywood and having the same strength as lauan plywood, the weight of the reflection plates can be reduced to provide a lightweight musical instrument. In the above described embodiment, the first and second reflection plates 100A, 100B each have a thickness of 14 mm, but this is not limitative. The thickness of these plates may be less than or greater than 14 mm.

In the above described embodiment, the first and second reflection plates 100A, 100B are mounted at predetermined angles to the bottom plate 101 of the instrument 10. However, the mounting angles of the first and second reflection plates 100A, 100B can be made variable in an arbitrary range of angle by forming sets of threaded holes in the projection 14*b* and the bottom plate 101 and by changing a set of threaded holes used for mounting the reflection plates 100A, 100B to thereby change mounting positions of the reflection plates 100A, 100B to the projection 14*b* and the bottom plate 101.

Figure 13:
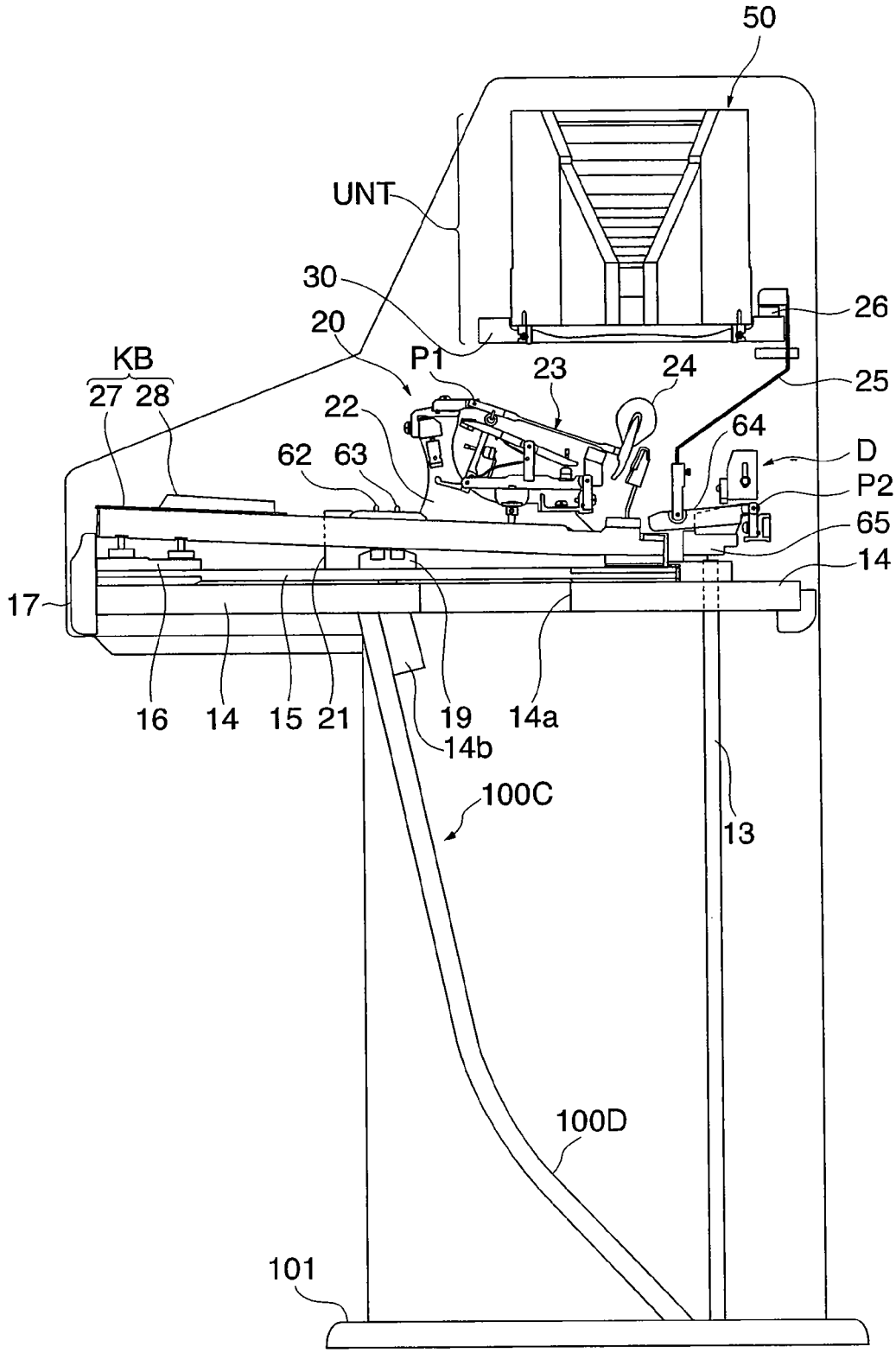
FIG. 13 is a schematic view showing the interior of a keyboard-type percussion instrument according to a modification of this invention.

In the above described embodiment, two plates, i.e., the first and second reflection plates 100A, 100B are used for reflecting musical tones. Alternatively, as shown in FIG. 13, one plate-shaped member 100C having a curved reflection surface 100D can be used to reflect musical tones having passed through the tone output ports 14*a*.

What is claimed is:

1. A keyboard-type percussion instrument comprising:

a plurality of sounding members each adapted to generate, when struck, a musical tone of a tone pitch proper to each sounding member;

a resonance box disposed above said sounding members and having a lower surface thereof which is open, said resonance box being adapted to cause a musical tone generated by each of said sounding members to resonate therein and to be output downward therefrom;

keys disposed to correspond to respective ones of said sounding members;

action mechanisms disposed below said sounding members to correspond to respective ones of said keys, each of said action mechanisms being adapted to strike a corresponding one of said sounding members in accordance with a motion of a corresponding one of said keys;

a keybed disposed below said keys and said action mechanisms and having at least one tone output port through which the musical tone output downward from said resonance box passes, said keybed being adapted to receive loads of said keys and said action mechanisms; and at least one reflection plate disposed below said keybed and adapted to reflect the musical tone having passed through said tone output port toward a predetermined direction, wherein said sounding members are arranged in a one-stage structure, and said action mechanisms are arranged in a one-stage structure to correspond to an arrangement of said sounding members.

2. The keyboard-type percussion instrument according to claim 1, wherein said reflection plate is comprised of a first reflection plate adapted to reflect the musical tone having passed through said tone output port and a second reflection plate adapted to reflect the musical tone reflected by said first reflection plate toward the predetermined direction.

3. The keyboard-type percussion instrument according to claim 2, wherein said first reflection plate is fixed to said keybed and a bottom plate, which is disposed below said keybed to face said keybed and forming a bottom surface of the keyboard-type percussion instrument.

4. The keyboard-type percussion instrument according to claim 1, wherein said reflection plate is comprised of one reflection plate having a curved reflection surface.

* * * * *